US005680914A

United States Patent [19]

Reiser

[11] Patent Number: 5,680,914

[45] Date of Patent: Oct. 28, 1997

[54] PORTABLE LAP OFFICE ASSEMBLY HAVING INTERNAL DESKTOP WRITING SURFACE

[76] Inventor: Douglas K. Reiser, 5966 Hemlock Dr., Great Bend, Kans. 67530

[21] Appl. No.: 513,220

[22] Filed: Aug. 10, 1995

[51] Int. Cl.[6] ..... A45F 3/00

[52] U.S. Cl. ..... 190/11; 190/110; 190/111; 312/195

[58] Field of Search ..... 190/11, 109, 110, 190/111; 312/348.3, 140.2, 195; 108/43, 125, 128

[56] References Cited

U.S. PATENT DOCUMENTS

| | | | |
|---|---|---|---|
| 1,436,859 | 11/1922 | Bush | 108/43 |
| 1,613,440 | 1/1927 | Carek | 108/43 |
| 2,187,445 | 1/1940 | Botelho | 190/110 X |
| 2,362,807 | 11/1944 | Dresner | 190/110 X |
| 2,536,169 | 1/1951 | Gray | 190/110 X |
| 2,609,072 | 9/1952 | Levinson | 190/11 |
| 3,082,049 | 3/1963 | Lifton | 190/11 X |
| 3,172,636 | 3/1965 | Collier | 108/43 |
| 3,710,900 | 1/1973 | Fink | 190/110 X |
| 4,052,944 | 10/1977 | Jennings | 108/43 |
| 4,404,915 | 9/1983 | Simpson | 108/43 |
| 4,506,769 | 3/1985 | Franco et al. | 190/110 X |
| 4,591,056 | 5/1986 | Groch | 190/110 X |
| 4,595,086 | 6/1986 | Simpson | 190/11 |
| 4,700,634 | 10/1987 | Mills et al. | 190/11 X |
| 4,765,583 | 8/1988 | Tenner | 248/444 |
| 5,081,936 | 1/1992 | Drieling | 108/43 |
| 5,090,334 | 2/1992 | Sutton | 108/43 |
| 5,295,742 | 3/1994 | Knutson | 312/244 |
| 5,447,215 | 9/1995 | Volkmar et al. | 190/11 |

*Primary Examiner*—Allan N. Shoap
*Assistant Examiner*—Christopher J. McDonald
*Attorney, Agent, or Firm*—Flanagan & Flanagan

[57] ABSTRACT

A portable lap office assembly having an internal desktop writing surface includes a case having a lower portion and an upper portion being hinged to the lower portion to undergo pivotal movement relative thereto between closed and open positions, each of the lower and upper portions having an exterior surface, an interior surface and a cavity defined by the interior surface, and a desktop insert fitted into the cavity of the lower portion of the case. The desktop insert has a frame with a bottom, top, pair of opposite sides and pair of opposite ends with the bottom surface of the frame being removably attachable to the interior surface of the lower portion of the case, at least one compartment formed in the frame and extending substantially between the opposite sides and substantially between the opposite ends of the frame, and at least one lid hinged to the top of the frame adjacent to a first of the opposite sides of the frame to undergo pivotal movement between closed and opened positions for covering and uncovering the compartment. The lid further has an upper surface providing a flat surface for writing thereon when the lid is in the closed position.

20 Claims, 2 Drawing Sheets

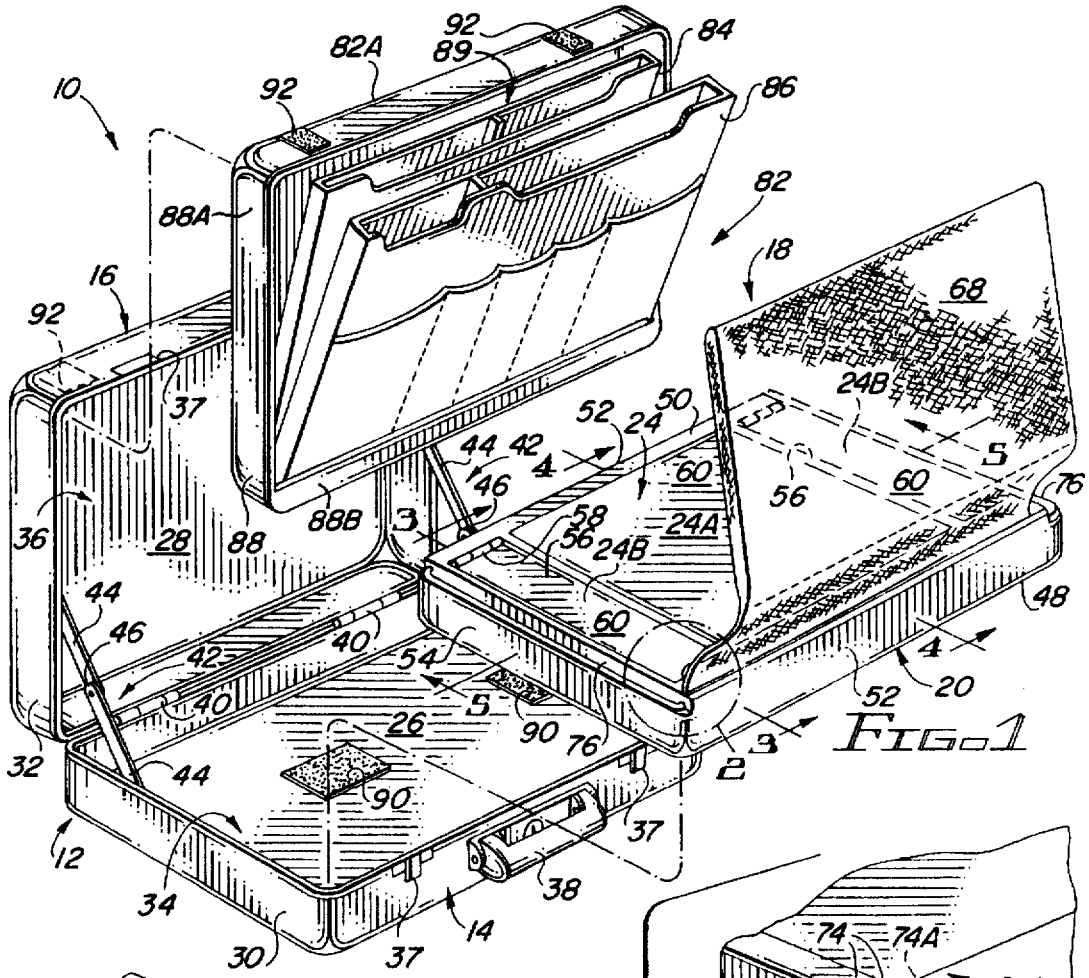
FIG. 1
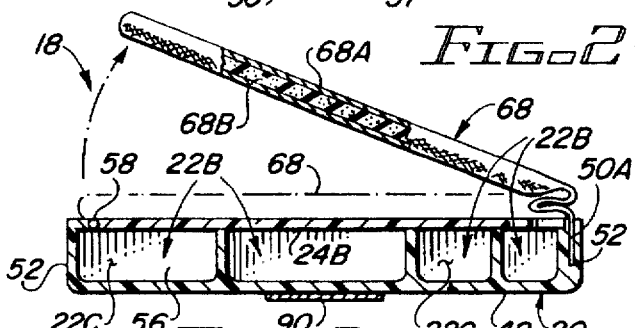
FIG. 2
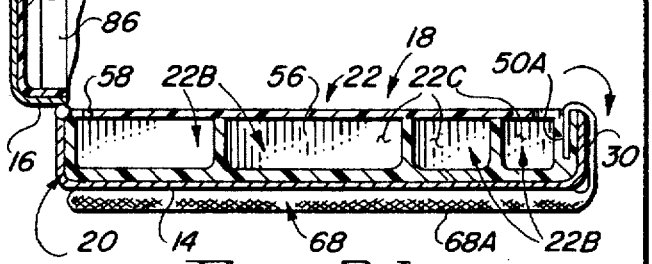
FIG. 3
FIG. 3A
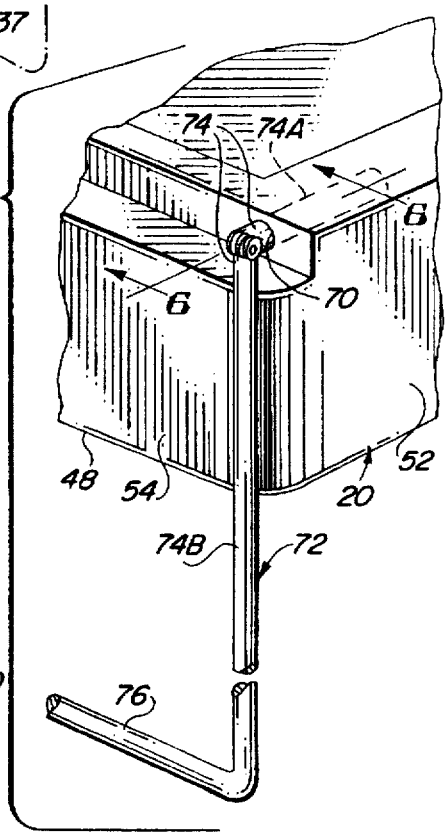

PORTABLE LAP OFFICE ASSEMBLY HAVING INTERNAL DESKTOP WRITING SURFACE

BACKGROUND OF THE INVENTION

1. Field of the Invention

The present invention generally relates to portable writing surfaces and, more particularly, is concerned with a portable lap office assembly having an internal desktop writing surface.

2. Description of the Prior Art

Many people write letters, take notes and pay bills in places where they do not have easy access to a desk or table such as in an automobile, on an airplane or at home while resting on a couch or reclining chair and watching television. Items such as briefcases and books are often used in these situations as surfaces to write on though these items are not intended for such use and often make the process of writing difficult.

A variety of devices have been developed over the years to provide portable writing surfaces in situations where a desk or table is not available. Representative examples of these devices are disclosed in U.S. Pat. Nos. 1,613,440 to Carek, 3,172,636 to Collier, 4,052,944 to Jennings, 4,595,086 to Simpson, 4,700,634 to Mills et al., 4,765,583 to Tenner, 5,081,936 to Drieling, 5,090,334 to Sutton and 5,295,742 to Knutson.

A problem exists, however, with most of the above listed devices in that only a few of them attempt to provide a case for carrying a writing surface and other accessory items such as papers and writing instruments. The patents to Simpson, Mills and Knutson each provide a carrying case, housing or container, but each appears to fall short of providing a comprehensive and sufficiently compact solution for a user who demands more than simply a writing surface but also enough storage capacity for the writing surface and accessory items.

Consequently, a need remains for a solution which is comprehensive and yet also sufficiently compact to overcome the aforementioned problems in the prior art without introducing new problems in their place.

SUMMARY OF THE INVENTION

The present invention provides a portable lap office assembly having an internal desktop writing surface designed to satisfy the aforementioned need. The present invention provides a comprehensive and compact solution for those who desire a portable writing surface and a carrying case having enough storing capacity for the writing surface and accessory items.

Accordingly, the present invention is directed to a portable lap office assembly having an internal desktop writing surface. The assembly comprises: (a) a case having a lower portion and an upper portion being hinged to the lower portion to undergo pivotal movement relative thereto between closed and open positions, each of the lower and upper portions having an exterior surface, an interior surface and a cavity defined by the interior surface; and (b) a desktop insert fitted into the cavity of the lower portion of the case, the desktop insert defining an upper flat surface for writing thereon. Also, the desktop insert has a frame with a bottom, top, pair of opposite sides, and pair of opposite ends with the bottom of the frame being removably attachable to the interior surface of the lower portion of the case. At least one compartment is formed in the frame and extends substantially between the opposite sides and substantially between the opposite ends of the frame. The desktop insert also has at least one lid hinged to the top of the frame adjacent to a first of the opposite sides of the frame to undergo pivotal movement between closed and opened positions for covering and uncovering the compartment. The lid has an upper surface providing the flat surface for writing thereon when the lid is in the closed position.

The desktop insert further has a body of padding attached to the top of the frame adjacent to a second of the opposite sides of the frame, means defining a passageway at each end of the opposite ends of the frame extending inwardly in substantially parallel relation to one another adjacent to the opposite sides of the frame, and a pair of U-shaped leg members having a pair of opposite side portions and a bottom portion extending between the opposite side portions with the opposite side portions slidably fitting into the passageways at each of the opposite ends of the frame.

More particularly, the body of padding is pivotally movable between a stored position wherein the body of padding rests on the upper surface of the lid and a user position wherein the body of padding extends about the second opposite side and the bottom of the frame or about the exterior surface of the lower portion of the case for providing comfortable support for positioning the assembly on the lap of a user. The pair of U-shaped leg members are convertible between a retracted storage position wherein the opposite side portions of the leg members are substantially disposed inside the passageways and a downwardly extending deployed position wherein the opposite side portions of the leg members substantially extend outside the passageways for supporting the case and desktop insert over the lap of the user or for supporting the desktop insert alone when detached from the lower portion of the case.

Furthermore, the assembly also comprises a file and accessory holding insert for fitting into the cavity of the upper portion of the case. The file and accessory holding insert has a cover with an exterior surface, an interior surface and a cavity defined by the interior surface. The exterior surface of the cover is removably attachable to the interior surface of the upper portion of the case. The file and accessory insert further has a plurality of pockets being hinged to the interior surface of the cover for pivotal movement between stored and open positions.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is an exploded perspective view of a portable lap office assembly of the present invention.

FIG. 2 is an enlarged fragmentary elevational view of the area of the portable lap office assembly enclosed by circle 2 of FIG. 1.

FIG. 3 is a side cross-sectional view of a desktop insert of the assembly taken along line 3—3 of FIG. 1, showing a body of padding elevated from a stored position.

FIG. 3A is a fragmentary side cross-sectional view of the desktop insert disposed within a case of the assembly showing the body of padding extended about a lower portion of the case in a user position.

DETAILED DESCRIPTION OF THE INVENTION

Figure 4:
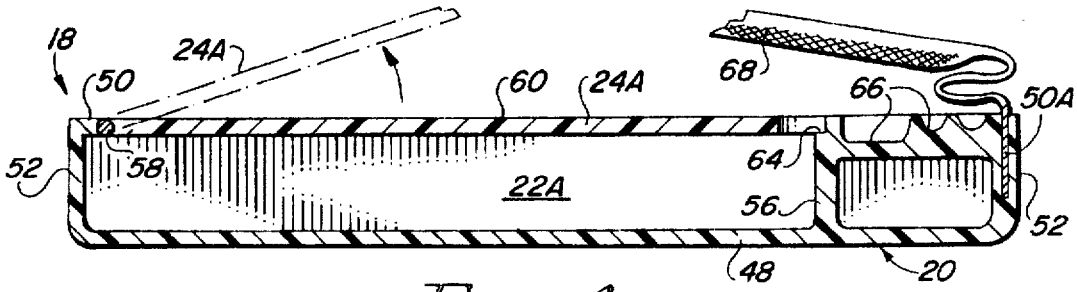
FIG. 4 is an enlarged side cross-sectional view of the desktop insert taken along line 4—4 of FIG. 1.
Figure 5:
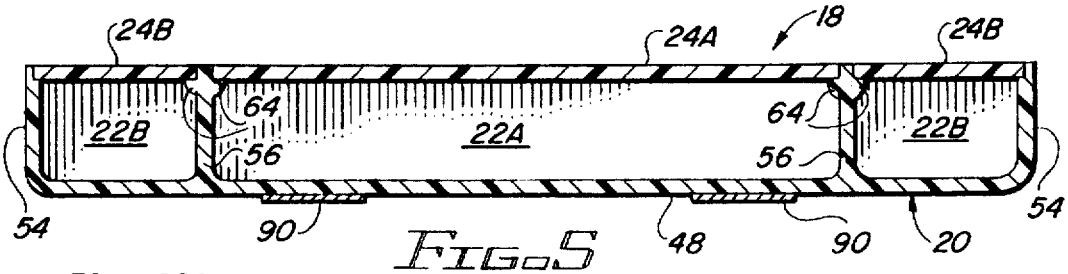
FIG. 5 is an enlarged front cross-sectional view of the desktop insert taken along line 5—5 of FIG. 1.
Figure 6:
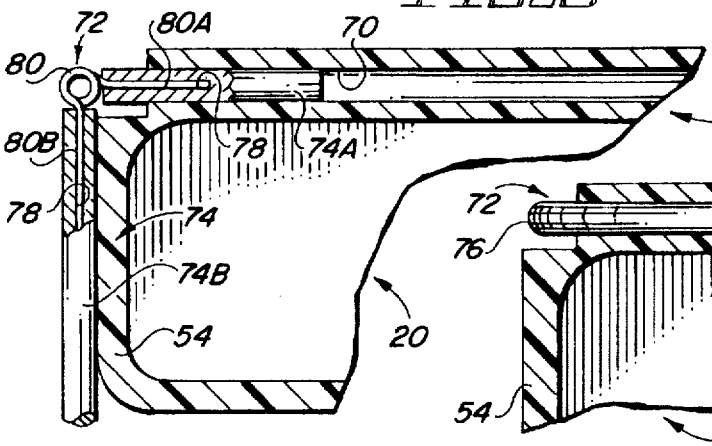
FIG. 6 is an enlarged fragmentary front cross-sectional view of the desktop insert showing a leg member in a deployed position taken along line 6—6 of FIG. 2.
Figure 7:
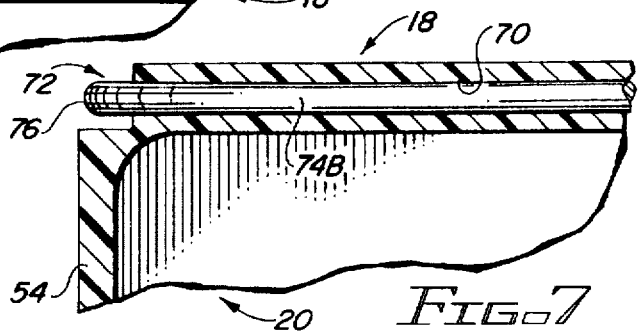
FIG. 7 is an enlarged fragmentary front cross-sectional view of the desktop insert showing the leg member in a retracted storage position.

Referring to the drawings, and particularly to FIG. 1, there is illustrated a portable lap office assembly, generally designated 10, of the present invention. The assembly 10 provides a comprehensive and compact solution for the user who desires a portable writing surface and a carrying case having enough storing capacity for the writing surface and accessory items.

The portable lap office assembly 10 basically includes a case 12 having a lower portion 14 and an upper portion 16 pivotally connected to the lower portion 14 to undergo pivotal movement relative thereto between closed and open positions, and a desktop insert 18 fitted into the lower portion 14 of the case 12 and defining a flat upper surface for writing thereon. The desktop insert 18 has a frame 20 fitted into the lower portion 14 of the case 12, at least one compartment 22, and at least one lid 24 for opening and closing access to the compartment 22. The case 12 by itself, without the desktop insert 18, has a well-known construction.

More particularly, the lower and upper portions 14, 16 of the case 12 are each substantially rectangular in shape and are respectively formed by bottom and top walls 26, 28, and continuous side walls 30, 32 attached to and surrounding the peripheries of the top and bottom walls 26, 28 so as to define respective lower and upper cavities 34, 36 in the corresponding lower and upper portions 14, 16 of the case 12. The lower and upper portions 14, 16 have respective exterior and interior surfaces 14A, 14B and 16A, 16B. The lower and upper portions 14, 16 have respective conventional latches 37 mounted on spaced front portions of the side walls 30, 32 thereof for releasably latching the lower and upper portions 14, 16 together in the closed postion. Also, the lower portion 14 of the case 12 further has a handle 38 pivotally attached on a front portion of the side wall 30 thereof for carrying the case 12. A back portion of the side wall 32 of the upper portion 16 is attached to a back portion of the side wall 30 of the lower portion 14 by means of a pair of hinges 40 to permit pivotally moving the upper portion 16 between the closed and open positions relative to the lower portion 14. The upper portion 16 of the case 12 is further retained in the open position relative to the lower portion 14 by a pair of support braces 42. Each support brace 42 includes a pair of links 44 being pivotally attached to the interior surfaces 14B, 16B of side portions of the respective side walls 30, 32 of the lower and upper portions 14, 16 and pivotally attached to one another by a hinge 46 for articulating the links 44 relative to each other and moving the upper and lower portions 16, 14 relative to each other between the closed and open positions.

Referring to FIGS. 1–5, the frame 20 of the desktop insert 18 is substantially rectangular in shape having a bottom 48, top 50, pair of opposite sides 52 and a pair of opposite ends 54. The frame 20 is smaller in size dimensions (that is, length, width and height) than the lower portion 14 of the case 12 for fitting within the cavity 34 thereof. In the one example of insert 18 illustrated in FIG. 1, the frame 20 at its bottom 48 is removably attachable to the lower portion 14 of the case 12 at the bottom wall 28 thereof. Alternatively, the frame 20 of the desktop insert 18 can be built into, and thus non-removably fitted within and attached to, the lower portion 14 of the case 12.

In the one example of the insert illustrated in FIGS. 1, 3, 5 and 8, the frame 20 also includes interior partitions 56 which divide the interior of the frame 20 into a center compartment 22A and a pair of opposite end compartments 22B. Each of the compartments 22A, 22B is substantially rectangular in shape, formed within the frame 20 and extends between the pair of the opposite sides 52 and between the pair of opposite ends 54 of the frame 20. More particularly, the opposite end compartments 22B extend between the opposite sides 52 and inwardly from the opposite ends 54 of the frame 20, while the center compartment 22A extends substantially between the opposite sides 52 of the insert 18 and between the end compartments 22B. Each of the end compartment 22B has a plurality of subcompartments 22C defined therein, as shown in FIGS. 3 and 3A.

Figure 8:
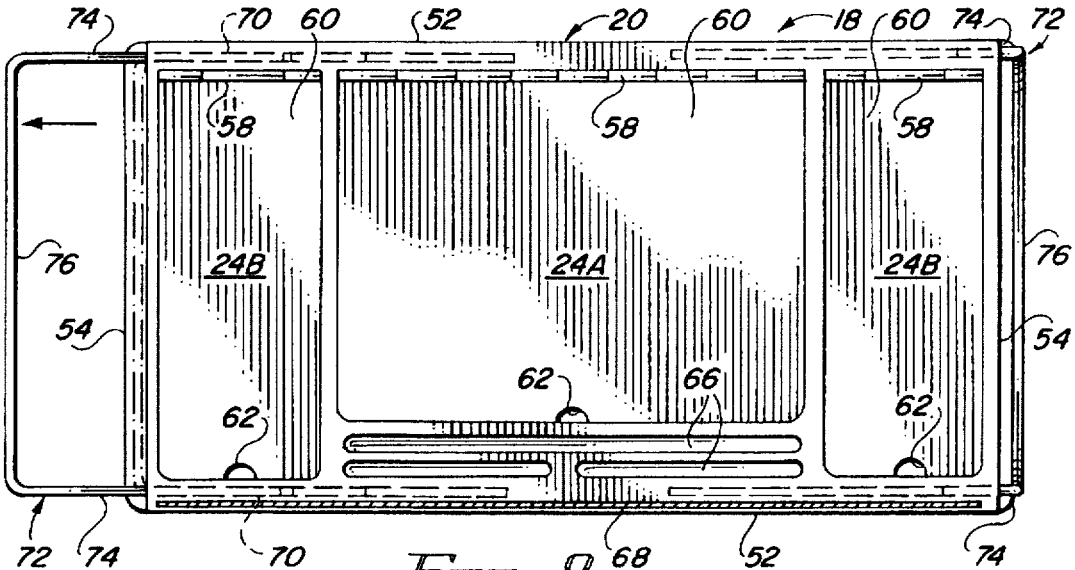
FIG. 8 is a top plan view of the desktop insert.

Further, in the one example of the insert 18 shown in FIGS. 1 and 8, the insert 18 has a center lid 24A for covering and uncovering the center compartment 22A and a pair of opposite end lids 24B for covering and uncovering the end compartments 22B. The center lid 24A and opposite end lids 24B are separately attached to the top 50 of the frame 20 of the insert 18 adjacent to a first of the opposite sides 52 of the frame 20 by means of respective hinges 58. The respective hinges 58 permit the corresponding lids 24A, 24B to undergo pivotal movement between closed and open positions for completely covering and uncovering the respective center and end compartments 22A, 22B. The upper surfaces 60 of the respective lids 24A, 24B when in the closed position provide the flat top surface on the desktop insert 18 for the user to write on. Each of the lids 24A, 24B has a crescent-shaped depression 62 defined in the front edge thereof which forms a finger grip adjacent to the second opposite side 52 of the frame 20. The top 50 of the frame 20 of the desktop insert 18 further has a plurality of ledges 64 formed on and protruding from partitions 56 to support the lids 24A, 26B when in the closed positions covering the respective compartments 22A, 22B. Also, a plurality of elongated depressions 66 are formed in the top 50 of the frame 20 between the second opposite side 52 of the frame 20 and the central compartment 22B and the end compartments 22A. The elongated depressions 66 are provided for storing accessory items.

Referring now to FIGS. 1, 3 and 3A, the desktop insert 18 further has a layer or body of padding 68 substantially rectangular in shape and attached to the top 50 of the frame 20 adjacent to the second opposite side 52 of the frame 20. The body of padding 68 is more particularly attached to the frame 20 by an adhesive substance such as glue in a slot 50A extending downward from the top surface 50 adjacent to the second opposite side 52 of the frame 20 and further is pivotally movable between stored and user positions. The body of padding 68 in the stored position, seen in broken line form in FIG. 3, rests on the upper surface 60 of the lids 24A, 24B and in the user position, seen in FIG. 3A, extends about the second opposite side 52 and the bottom 48 of the frame 20 if the desktop insert 18 is removed from the case 12 or about the exterior surface 16A of the bottom wall 26 of the lower portion 14 of the case 12 for providing a cushioned, comfortable support for positioning the assembly 10 on the lap of a user. The body of padding 68 is comprised substantially of an outer fabric 68A and an inner pad 68B of a suitable material, such as foam rubber or the like, for placing on the lap of the user. A short section of the outer fabric 68A extends beyond the inner pad 68A along one end of the body of padding 68 and is employed to flexibly attach the body of padding 68 to the frame 20 of the desktop insert 18 for extending the body of padding 68 thereabout.

Referring now to FIGS. 1, 2, 6 to 8, the desktop insert 18 further includes means defining a pair of spaced passageways 70 substantially cylindrical in shape at the opposite ends 54 of the frame 20 which extend inwardly therein in substantially parallel relation to one another adjacent to the opposite sides 52 of the frame 20. Also, the insert 18 also includes a pair of U-shaped leg members 72 substantially cylindrical in shape and having a pair of opposite side portions 74 and a bottom portion 76 connected to and extending between the opposite side portions 74. The opposite side portions 74 of the leg members 72 have smaller diameters than the passageways 70 so as to slidably fit into the passageways 70 at each of the opposite ends 54 of the frame 20. Each of the leg members 72 are further convertible between a retracted storage position when the opposite side portions 74 are substantially disposed inside the passageways 70 and a downwardly extending deployed position when the opposite side portions 74 are substantially extended outside the passageways 70. When in the deployed positions, the leg members 72 support the desktop insert 18 when the frame 20 of the desktop insert 18 is detached from the lower portion 14 of the case 12 or support the case 12 where the frame 20 is made as a permanent part of the case 12.

Each of the opposite side portions 74 of the U-shaped leg members 72 is comprised of a pair of first and second links 74A, 74B. The first link 74A has a length which is substantially shorter than the length of the second link 74B. The first and second links 74A, 74B are both disposed within the passageway 70 when the leg members 72 are in the retracted storage position. Each bottom portion 76 of the leg members 72 remains disposed outside along one of the opposite ends 54 of the frame 20. The first link 74A remains disposed substantially inside the passageway 70 and the second link 74B extends substantially outside the passageway 70 and downwardly perpendicular to the first link 74A when the leg members 72 are in the downwardly extending deployed position. The first and second links 74A, 74B also have passages 78 defined therein. In the one example of the U-shaped leg members 72 shown in FIG. 6, means in the form of a coiled spring 80 are provided for biasing the leg members 72 to the downwardly extending deployed position. The biasing spring 80 is disposed between the first and second links 74A and 74B such that a pair of opposite legs 80A, 80B of the spring 80 extend into the respective passages 78 of the links.

Referring now to FIG. 1, the assembly 10 further includes a file and accessory holding insert 82 being substantially rectangular in shape and smaller in size than the upper portion 16 of the case 12 for fitting within the upper cavity 36 of the upper portion 16 of the case 12. The file and accessory holding insert 82 has a plurality of file pockets 84 and accessory pockets 86, and a cover 88 having an interior cavity 89. The cover 88 of the file and accessory holding insert 82 at its exterior surface 88A is removably attachable to the interior surface 16B of the upper portion 16 of the case 12. The file and accessory pockets 84, 86 are pivotally attached to their lower edges to the lower portion 88B of the cover 88.

In the case where the desktop insert 18 is removable from the case 12, preferably the bottom 48 of the frame 20 of the desktop insert 18 and the interior surface 14B of the bottom wall 26 of the lower portion 14 of the case 12 have complementary patches 90 of mateable hook and loop fastening elements for removably attaching the desktop insert 18 therein. Further, the exterior surface 88A of the cover 88 of the file and accessory holding insert 82 and the interior surface 16B of the top wall 28 of the upper portion 16 of the case 12 likewise have complementary patches 92 of mateable hook and loop fastening elements for removably attaching the file and accessory holding insert 82 therein.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A portable lap office assembly, comprising:

(a) a case having a lower portion and an upper portion being hinged to said lower portion to undergo pivotal movement relative thereto between closed and open positions, each of said lower and upper portions having an exterior surface, an interior surface and a cavity defined by said interior surface; and (b) a desktop insert fitted into said cavity of said lower portion of said case, said desktop insert defining an upper flat surface for writing thereon, said desktop insert including (i) a frame having a bottom, top, pair of opposite sides and pair of opposite ends, said bottom of said frame being removably attachable to said interior surface of said lower portion of said case, (ii) a pair of opposite end compartments formed in said frame and extending substantially between said opposite sides and inwardly from said opposite ends of said frame, each of said end compartments having a plurality of spaced interior partitions defining a plurality of subcompartments therein, (iii) a central compartment formed in said frame and extending substantially between said opposite sides and substantially between said opposite end compartments, and (iv) a plurality of lids movably mounted to said top of said frame to undergo movement between closed and opened positions relative to said frame for covering and uncovering said respective compartments, wherein at least the one of said lids covering said central compartment when in said closed position defines said upper flat surface of said desktop insert for writing thereon.

2. The assembly of claim 1 further comprising:

(c) a pair of leg members mounted to opposite sides of one of said desktop insert and said bottom portion of said case and being convertible between a retracted storage position adjacent to said one of said desktop insert and said bottom portion of said case and a downwardly extending deployed position away from said bottom portion of said case.

3. The assembly of claim 1 further comprising:

(c) a file and accessory holding insert having a plurality of pockets, said file and accessory holding insert being attached to said interior surface of said upper portion of said case and fitted into said cavity of said upper portion of said case.

4. A portable lap office assembly, comprising:

(a) a case having a lower portion and an upper portion being hinged to said lower portion to undergo pivotal movement relative thereto between closed and open positions, each of said lower and upper portions having an exterior surface, an interior surface and a cavity defined by said interior surface;

(b) a desktop insert fitted into said cavity of said lower portion of said case, said desktop insert defining an upper flat surface for writing thereon; and (c) a body of padding attached to said desktop insert and being movable relative thereto between stored and user positions, said body of padding resting on said upper flat surface of said desktop insert when in said stored position and extending about said exterior surface of said lower portion of said case when in said user position for providing comfortable support for positioning said assembly on the lap of a user.

5. The assembly of claim 4 wherein said desktop insert includes a frame having a bottom, top, pair of opposite sides and pair of opposite ends, said bottom of said frame being removably attachable to said interior surface of said lower portion of said case.

6. The assembly of claim 5 wherein said desktop insert further includes a compartment formed in said frame and extending substantially between said opposite sides and substantially between said opposite ends of said frame.

7. The assembly of claim 6 wherein said desktop insert further includes a lid hinged to said top of said frame adjacent to a first of said opposite sides of said frame to undergo pivotal movement between closed and opened positions for covering and uncovering said compartment, said lid having an upper surface and a lower surface, said upper surface of said lid in said closed position providing said upper flat surface for writing thereon.

8. A portable lap office assembly, comprising:

(a) a case having a lower portion and an upper portion being hinged to said lower portion to undergo pivotal movement relative thereto between closed and open positions, each of said lower and upper portions having an exterior surface, an interior surface and a cavity defined by said interior surface; and (b) a desktop insert fitted into said cavity of said lower portion of said case, said desktop insert including (i) a frame having a bottom, top, pair of opposite sides and pair of opposite ends, said bottom of said frame being removably attachable to said interior surface of said lower portion of said case, said top of said frame defining an upper flat surface for writing thereon, and (ii) a body of padding attached to said top of said frame adjacent to a second of said opposite sides of said frame, said body of padding being movable between stored and user positions, said body of padding resting on said top of said frame when in said stored position and said body of padding extending about said second opposite side and said bottom of said frame and said exterior surface of said lower portion of said case when in said user position for providing support for positioning said assembly on the lap of a user.

9. A portable lap office assembly, comprising:

(a) a case having a lower portion and an upper portion being hinged to said lower portion to undergo pivotal movement relative thereto between closed and open positions, each of said lower and upper portions having an exterior surface, an interior surface and a cavity defined by said interior surface; and (b) a desktop insert fitted into said cavity of said lower portion of said case, said desktop insert including a frame having a bottom, top, pair of opposite sides and pair of opposite ends, said bottom of said frame being removably attachable to said interior surface of said lower portion of said case, said top of said frame defining an upper flat surface for writing thereon, said frame having a passageway at each of said opposite ends of said frame extending inwardly in substantially parallel relation to one another adjacent to said opposite sides of said frame.

10. The assembly of claim 9 wherein said desktop insert further includes a pair of U-shaped leg members having a pair of opposite side portions and a bottom portion extending between said opposite side portions, said opposite side portions slidably fitting into said passageways at each of said opposite ends of said frame, said leg members being convertible between a retracted storage position wherein said opposite side portions are substantially disposed inside said passageways and a downwardly extending deployed position wherein said opposite side portions substantially extend outside said passageways for supporting said case and desktop insert over the lap of the user or for supporting said desktop insert alone when detached from said lower portion of said case.

11. A portable desktop insert for a carrying case, said desktop insert comprising:

(a) a frame having a bottom, top, pair of opposite sides and pair of opposite ends, said frame at said bottom thereof being removably attachable to the inside of the carrying case;

(b) a pair of opposite end compartments formed in said frame and extending substantially between said opposite sides and inwardly from said opposite ends of said frame, each of said end compartments having a plurality of spaced interior partitions defining a plurality of subcompartments therein;

(c) a central compartment formed in said frame and extending substantially between said opposite sides and substantially between said opposite end compartments; and (d) a plurality of lids movably mounted to said top of said frame to undergo movement between closed and opened positions relative to said frame for covering and uncovering said respective compartments, wherein at least the one of said lids covering said central compartment when in said closed position defines said upper flat surface of said desktop insert for writing thereon.

12. The desktop insert of claim 11 wherein said frame has a passageway at each end of said opposite ends of said frame extending inwardly in substantially parallel relation to one another adjacent to said opposite sides of said frame.

13. The desktop insert of claim 12 further comprising:

(e) a pair of U-shaped leg members having a pair of opposite side portions and a bottom portion extending between said opposite side portions, said opposite side portions slidably fitting into said passageways at each of said opposite ends of said frame, said leg members being convertible between a retracted storage position wherein said opposite side portions are substantially disposed inside said passageways and a downwardly extending deployed position wherein said opposite side portions substantially extend outside said passageways for supporting said desktop insert.

14. A portable desktop insert for a carrying case, said desktop insert comprising:

(a) a frame having a bottom, top, pair of opposite sides and pair of opposite ends, said frame at said bottom thereof being removably attachable to the inside of the carrying case;

(b) a compartment formed in said frame and extending substantially between said opposite sides and substantially between said opposite ends of said frame;

(c) a lid hinged to said top of said frame adjacent to a first of said opposite sides of said frame to undergo pivotal movement between closed and opened positions for covering and uncovering said compartment, said lid having an upper surface and a lower surface, said upper surface of said lid in said closed position providing a flat surface for writing thereon; and (d) a body of padding attached to said top of said frame adjacent to a second of said opposite sides of said frame, said body of padding being movable between stored and user positions, said body of padding resting on said upper surface of said lid when in said stored position and said body of padding extending about said second opposite side and said bottom of said frame or about an exterior surface of the case when in said user position for providing support for positioning said desktop insert on the lap of a user.

15. A portable lap office assembly, comprising:

(a) a case having a lower portion and an upper portion being hinged to said lower portion to undergo pivotal movement relative thereto between closed and opened positions, each of said lower and upper portions having an exterior surface, an interior surface and a cavity defined by said interior surface;

(b) a desktop insert for fitting into said cavity of said lower portion of said case, said desktop insert including (i) a frame having a bottom, top, pair of opposite sides and pair of opposite ends, said bottom of said frame being removably attachable to said interior surface of said lower portion of said case, (ii) a pair of opposite end compartments formed in said frame and extending substantially between said opposite sides and inwardly from said opposite ends of said frame, (iii) a central compartment formed in said frame and extending substantially between said opposite sides and substantially between said opposite end compartments, (iv) a plurality of lids, each lid being hinged to said top of said frame adjacent to a first of said opposite sides of said frame to undergo pivotal movement between closed and opened positions for covering and uncovering one of said compartments, each of said lids having an upper surface and a lower surface, each of said upper surfaces of said lids in said closed position providing a flat surface for writing thereon, (v) a body of padding attached to said top of said frame adjacent to a second of said opposite sides of said frame, said body of padding being movable between stored and user positions, said body of padding resting on said upper surfaces of said lids when in said stored position and said body of padding extending about said second opposite side and said bottom of said frame or about said exterior surface of said lower portion of said case when in said user position for providing support for positioning said assembly on the lap of a user, (vi) said frame having a passageway at each end of said opposite ends of said frame extending inwardly in substantially parallel relation to one another adjacent to said opposite sides of said frame, and (vii) a pair of U-shaped leg members having a pair of opposite side portions and a bottom portion extending between said opposite side portions, said opposite side portions slidably fitting into said passageways at each of said opposite ends of said frame, said leg members being convertible between a retracted storage position when said opposite side portions are substantially disposed inside said passageways and a downwardly extending deployed position when said opposite side portions extend substantially outside said passageways for supporting said desktop insert when said frame of said desktop insert is detached from said lower portion of said case; and (c) a file and accessory holding insert for fitting into said cavity of said upper portion of said case, said file and accessory holding insert including (i) a cover having an exterior surface, an interior surface and a cavity defined by said interior surface, said exterior surface of said cover being removably attachable to said interior surface of said upper portion of said case, and (ii) a plurality of pockets being hinged to said interior surface of said cover for pivotal movement between stored and open positions.

16. The assembly of claim 15 wherein said bottom of said frame of said desktop insert and said interior surface of said lower portion of said case have complementary patches of mateable hook and loop fastening elements for removably attaching said desktop insert to said interior surface of said lower portion of said case.

17. The assembly of claim 15 wherein said exterior surface of said cover of said file and accessory holding insert and said interior surface of said upper portion of said case have complementary patches of mateable hook and loop fastening elements for removably attaching said file and accessory holding insert to said interior surface of said upper portion of said case.

18. The assembly of claim 15 wherein each of said opposite side portions of said U-shaped leg members has a first and second link each having a length, said second link having a substantially greater said length than said length of said first link.

19. The assembly of claim 18 wherein each of said opposite side portions of said U-shaped leg members has means for biasing said leg members to said downwardly extending deployed position, said biasing means being disposed between said first and second links of said opposite side portions of said leg members.

20. The assembly of claim 15 wherein each of said end and central compartments of said desktop insert have a plurality of spaced interior partitions defining a plurality of subcompartments therein.

* * * * *